United States Patent [19]

Chow et al.

[11] Patent Number: 4,736,891

[45] Date of Patent: Apr. 12, 1988

[54] ASPIRATION-TYPE SPRAYER

[75] Inventors: Ho Chow, Cliffside Park; Sidney J. Goodman, Paramus, both of N.J.

[73] Assignee: Hunter-Melnor, Inc., Memphis, Tenn.

[21] Appl. No.: 890,016

[22] Filed: Jul. 28, 1986

[51] Int. Cl.[4] ..... B05B 7/12

[52] U.S. Cl. ..... 239/318; 239/396

[58] Field of Search ..... 239/317, 318, 396

[56] References Cited

U.S. PATENT DOCUMENTS

| | | | |
|---|---|---|---|
| 2,149,611 | 3/1939 | Lohse . | |
| 2,293,390 | 8/1942 | Hergesbach | 239/318 |
| 2,369,326 | 2/1945 | Tirrell . | |
| 2,788,244 | 4/1957 | Gilmour | 239/318 X |
| 2,788,245 | 4/1957 | Gilmour | 239/318 X |
| 3,042,314 | 7/1962 | Packard et al. | 239/318 X |
| 3,112,884 | 12/1963 | Gilmour | 239/318 |
| 3,204,875 | 9/1965 | Langstroth | 239/318 |
| 3,254,844 | 6/1966 | Blasnile et al. | 239/318 |
| 3,291,395 | 12/1966 | Sharp | 239/318 |
| 3,763,888 | 10/1973 | Duecker | 239/318 X |
| 4,349,157 | 9/1982 | Beiswenger et al. | 239/318 X |
| 4,369,921 | 1/1983 | Beiswenger et al. | 239/318 X |
| 4,475,689 | 10/1984 | Hauger et al. | 239/318 |

*Primary Examiner*—Andres Kashnikow
*Assistant Examiner*—Mary Beth O. Jones
*Attorney, Agent, or Firm*—James & Franklin

[57] ABSTRACT

An aspiration sprayer comprises a disc valve for controlling the degree of aspiration over a very wide range by means of a plurality of passages of different sizes formed in the disc valve and selectively introduced into the flow path of the liquid to be aspirated, the disc valve rotating with a knob and being spring-urged into leak-proof relationship with that flow path, the carrier liquid with aspiration material entrained therein emerging from the sprayer in a strong jet-like stream the nature and direction of which can be modified by a deflector mounted on the device so as to be slidable between operative positions. The knob and the disc valve may be readily assembled and disassembled and the operative passages of the valve are accessible for cleaning without requiring disassembly of the device. The passages in the disc valve may comprise a plurality of radially enlarged vortex areas interconnected by spaces of lesser width.

28 Claims, 6 Drawing Sheets

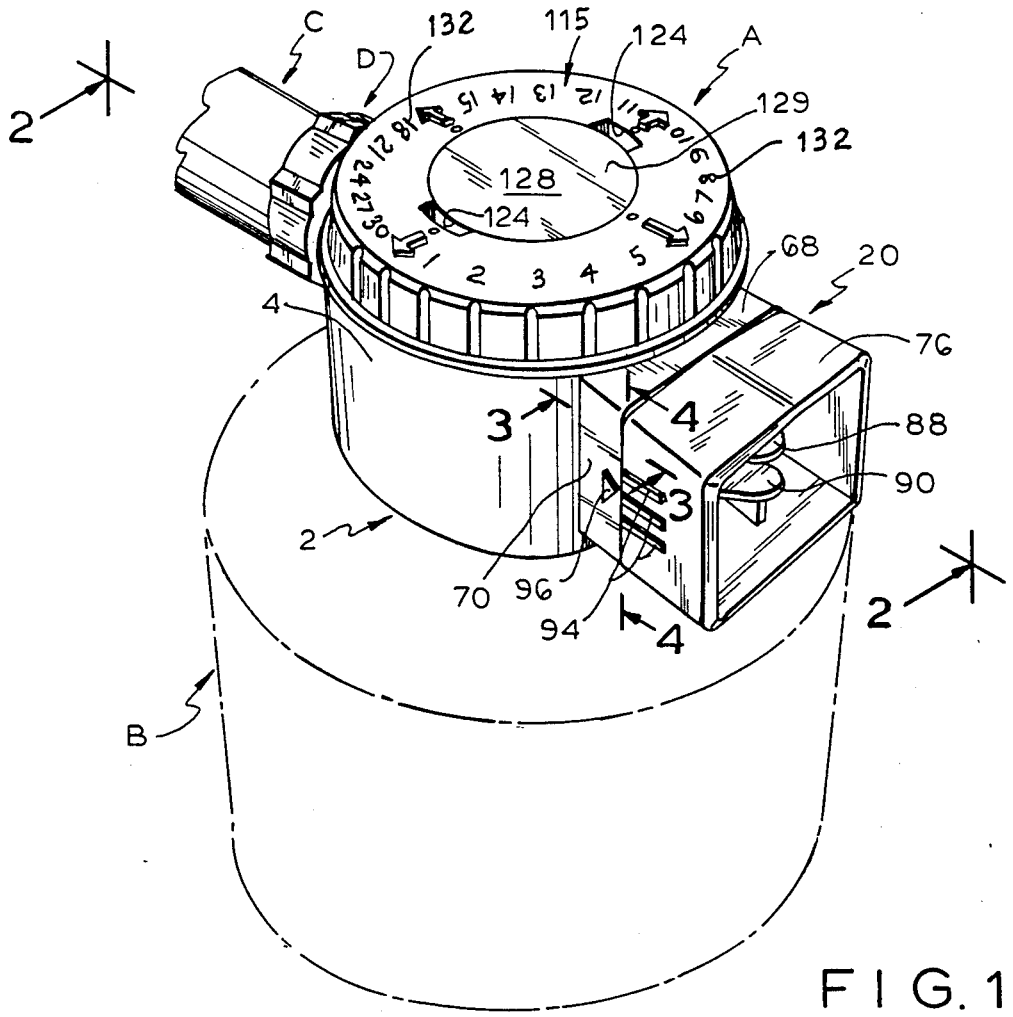
FIG. 1
FIG. 8
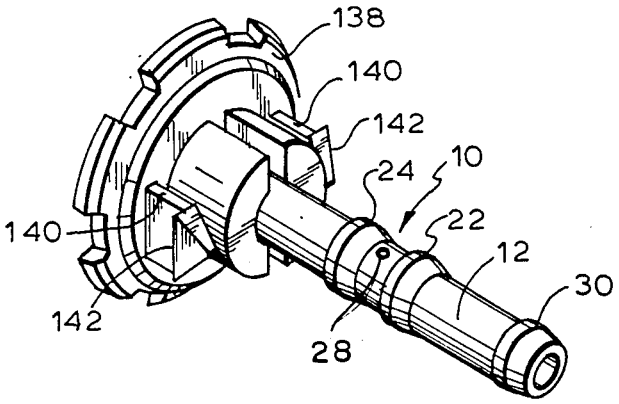

ASPIRATION-TYPE SPRAYER

The present invention relates to the construction of an aspiration-type sprayer so as to facilitate assembly, reduce cost, and in particular to provide control of the degree of aspiration over an exceptionally wide range and control of the nature and orientation of the fluid stream emanating from the device.

Aspiration-type sprayers are commonly used to mix relatively small quantities of an additive material with relatively large quantities of a carrier fluid such as water, the mixing being effected by causing the carrier fluid to pass rapidly over an opening which communicates with the interior of a container carrying the additive material and produce a suction effect which sucks the additive material into the stream of carrier fluid. This type of sprayer is frequently used in an agricultural environment, to apply chemicals of various types (e.g. fertilizers and pesticides) to bushes and trees. The present invention will be here disclosed as specially designed for such a use, with the additive material being generally referred to for purposes of convenience as an insecticide, but it should be appreciated that it is not limited to such applications, and that the additive material need not be an insecticide.

The aspirating sprayer of the present invention is here specifically disclosed as being attachable to and detachable from a container, which may be the original container for the insecticide or which may be a container designed to receive predetermined amounts of the insecticide and an appropriate diluent therefor, but it is not necessarily limited to use in that fashion. Making it usable with a container in which the concentration of the insecticide can be varied as appropriate to the particular insecticide employed and the particular environment where the insecticide is to be used is advantageous, particularly where the device is likely to be used in a wide variety of different applications. Being able to vary the concentration of the insecticide in the container gives some control over the concentration of insecticide actually to emanate from the sprayer, but it is also very desirable that the sprayer be capable of varying the proportion of additive (insecticide plus initial dilutant) with respect to the carrier fluid, usually water from a hose outlet. To provide a simple and inexpensive construction which is capable of control of that latter relationship over a wide range is quite difficult.

Insecticides or other materials to be sprayed, even when initially diluted, are often dangerous to humans, certainly if taken internally and frequently if applied externally. Hence it is important that the sprayers used with such substances function effectively to seal those substances within the container when aspiration is not desired and to cause desired aspiration to occur without leaks which might be the source of trouble of harm, and without unduly subjecting the user to peril from the insecticide. Again, the accomplishment of these results by a simple and inexpensive construction presents significant problems.

In addition, since the sprayers under discussion are designed primarily for use by the suburban population in connection with their lawns and gardens, and because that population is as a rule neither technically oriented nor trained, operation of the sprayer in order to achieve its desired objectives must be simple.

If the sprayer is to be adaptable for use in different applications it must be capable not only of wide variation in the amount of additive sprayed and the rate of that spraying but it must also be capable of producing an output stream of considerable force so that it can reach remote branches and inaccessible ground areas while at the same time being capable of spraying nearby areas, low lying areas and high areas.

The aspiration sprayer here disclosed achieves the above set forth objectives in a simple, reliable and inexpensive manner. The path of the aspiration liquid between the container and the aspiration opening where that liquid is sucked into the carrier fluid is interrupted by a disc valve provided with a plurality of selectively usable passages through which the aspiration fluid flows, the rate of that flow being determined by variations in the size and configuration of those passages. A very large number of such passages may be disposed on a single disc valve, thus enabling the device to provide a very large number of different aspiration rates extending over a very wide range. The disc is connected to a manually accessible knob so that it may be appropriately positioned to bring a desired passage into the flow path for the aspiration liquid, or to completely interrupt that flow path so that no aspiration occurs and the interior of the container for the insecticide is sealed. A spring acts on the disc valve to index it and urge it into sealing relationship with the aspiration flow path, and in a preferred form that spring also acts on the knob to tend to move the knob to a disassembled position, the knob normally being reliably retained in its assembled position resisting that spring action.

The passages in the disc valve (in the invention as here disclosed there are 20 different passages) are relatively small, and hence susceptible to faulty function unless they are kept clean and free of debris or accumulation of chemical deposits. While disassembly of the sprayer to remove the disc valve for cleaning is not difficult, it is nevertheless desirable to avoid such disassembly if at all possible, particularly since these sprayers are used by ordinary householders, and hence the sprayer is so constructed that the face of the disc valve carrying the passages is extensively exposed when the disc valve is mounted for use, so that cleaning of the passages can be accomplished without requiring any disassembly of the device.

The sprayer as here disclosed embodies closed-gap aspiration, which inherently tends to produce a reasonably coherent and strong output stream, but the strength and coherency of that stream is further enhanced by specific constructional features. Moreover, a deflector is mounted on the sprayer for slidable movement thereover between operative positions where the output stream is differently physically modified.

It is therefore the prime object of the present invention to devise an aspiration-type sprayer of simple, reliable and inexpensive construction which provides an outstandingly large degree of control over aspiration rate and the nature and orientation of the output stream.

It is a further object of the present invention to devise a sprayer of compact size and low weight which is nevertheless sturdy, effective and capable of use in many different environments.

It is yet another object of the present invention to devise an aspiration-type sprayer of standardised construction in which the magnitude and ranges of aspiration rates over different wide ranges can be accomplished merely by substituting one particular disc valve for another.

To the accomplishment of the above, and to such other objects as may hereinafter appear, the present invention relates to the construction of an aspiration-type sprayer as defined in the appended claims and as described in this specification, taken together with the accompanying drawings in which FIG. 1 is a three-quarter perspective view of the sprayer of the present invention in position on a container;

FIG. 8 is a three-quarter perspective exploded view of the nozzle and anti-siphon device.

The sprayer, generally designated A, is designed to be screwed onto the neck of a container generally designated B for the material to be sprayed, such as insecticide. The container B may be filled with insecticide of desired concentration by mixing an appropriate volume of insecticide with an appropriate volume of diluent such as water. The carrier fluid, in the embodiment here disclosed, is a stream of water coming from, for example, a garden hose C adapted to be secured to the sprayer by a coupling nut generally designated D.

Figure 2:
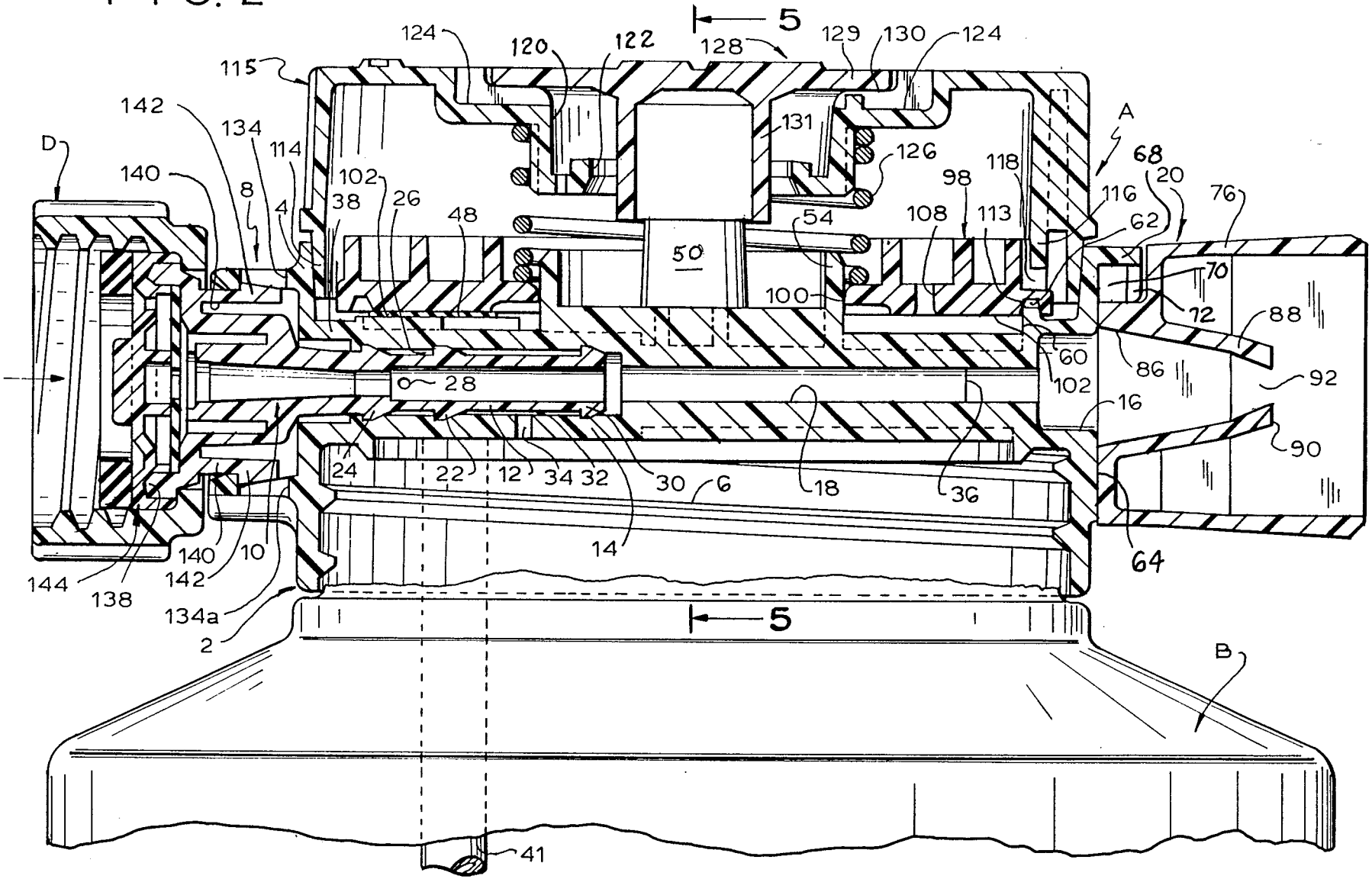
FIG. 2 is a cross-sectional view on an enlarged scale, taken along the line 2—2 of FIG. 1.
Figure 5:
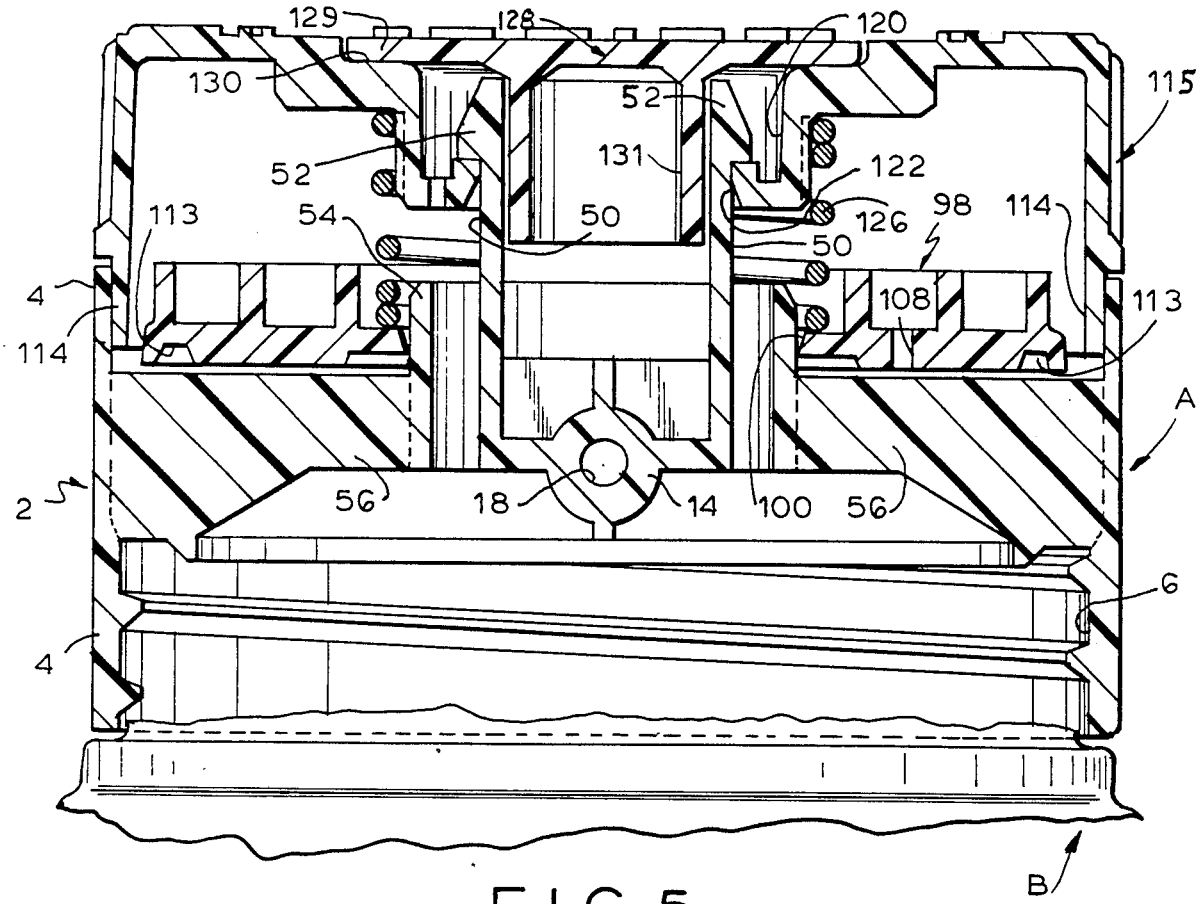
FIG. 5 is a cross-sectional view taken along the line 5—5 of FIG. 2.
Figure 3:
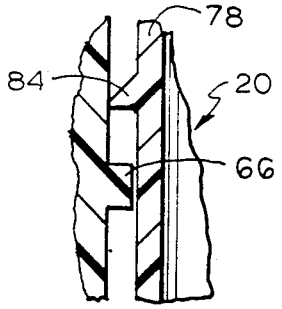
FIG. 3 is a cross-sectional view taken along the line 3—3 of FIG. 1.
Figure 4:
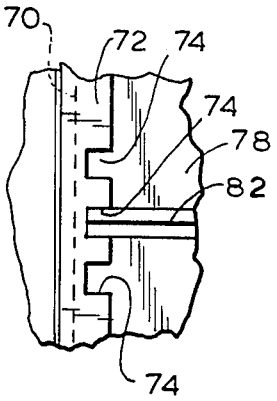
FIG. 4 is a cross-sectional view taken along the line 4—4 of FIG. 1.

The container B is here disclosed in the form of a jar or bottle the neck of which, suggested but not shown in FIG. 2, is externally threaded. The sprayer A comprises a body generally designated 2 provided with a depending and upstanding rim 4 the depending portion of which is internally threaded at 6 so as to be receivable onto and removable from the neck of the container B. The rear of the rim 4 carries a mounting structure 8 on which the coupling nut D and an associated nozzle structure generally designated 10 is adapted to be mounted, the nozzle structure 10 having a forwardly extending portion 12 which is received within a tube 14 extending from the rear to the front of the body 2, there opening into a wide recess 16. The carrier fluid is designed to enter the sprayer through the coupling nut D, to pass through the nozzle structure 10, including its forwardly extending portion 12, and then to flow through an elongated passage 18 in the tube 14 to the recess 16, from which the carrier fluid, with or without aspiration material, exits in the form of a stream.

Mounted on the front of the rim 4 is a stream deflector generally designated 20 which may be moved between a plurality of operative positions, here specifically shown as three in number, so as to selectively modify the direction and nature of the output stream as it emanates from the recess 16.

The nozzle portion 12 is provided with radially enlarged portions 22 and 24 which are sealingly received within the tube 14 so as to define a closed annular space 26 around the nozzle portion 12, the nozzle portion 12 being provided with another radially enlarged portion 30 which sealingly engages the interior of the tube 14, thereby to form a closed annular space 32 between the nozzle portion 12 and the tube 14, and the tube 14 is provided with an opening 34 between the annular space 32 and the lower surface of the tube 14.

The passage 18 in the tube 14 is at its left-hand end as viewed in FIG. 2 slightly larger in cross-section than the axial opening of the nozzle portion 12, and the passage 18 is gradually constricted from left to right up to the point 36. This arrangement, it has been discovered, significantly increases the strength of the output stream.

Figure 6:
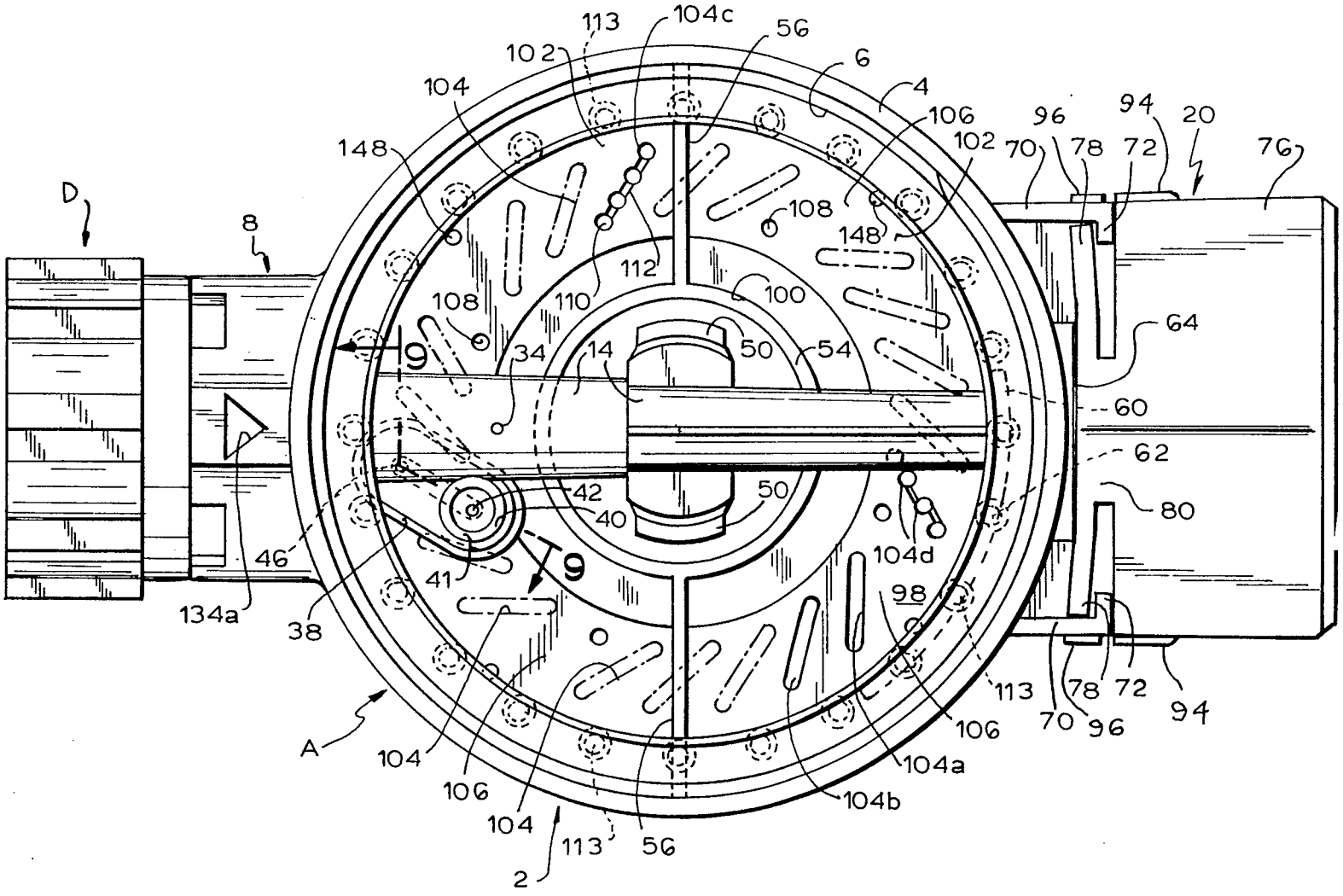
FIG. 6 is a bottom plan view, on an enlarged scale, of the sprayer.
Figure 7:
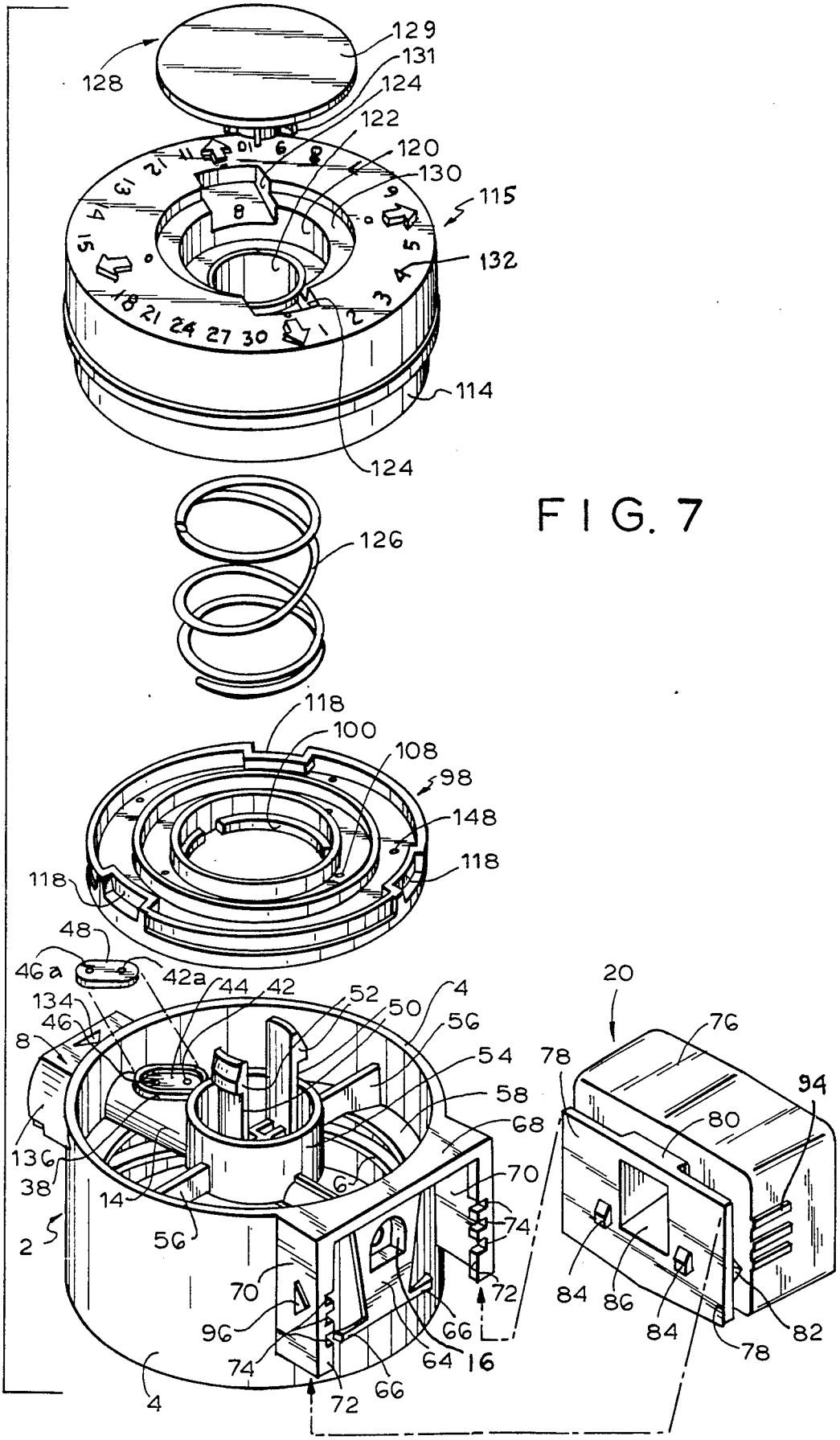
FIG. 7 is a three-quarter perspective exploded view of the sprayer.
Figure 9:
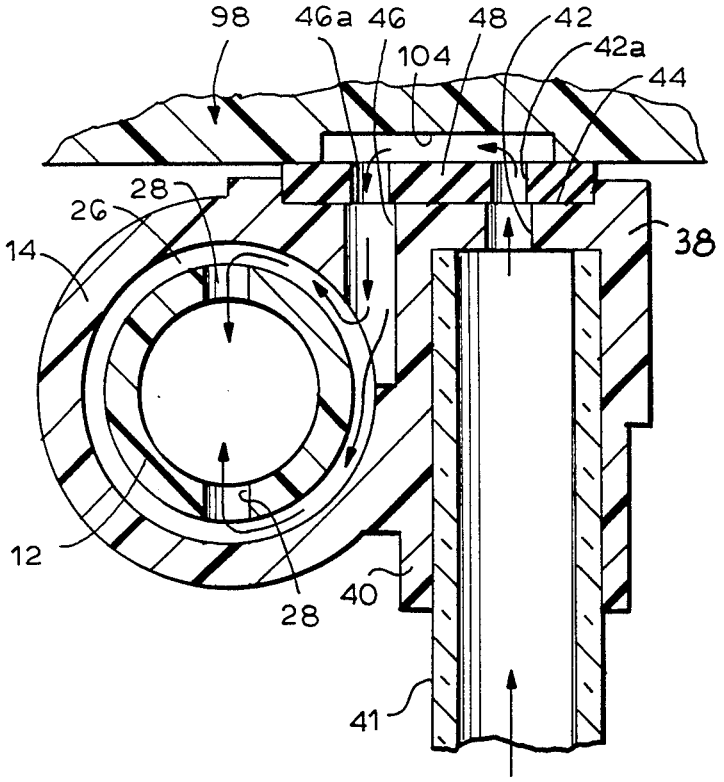
FIG. 9 is a cross-sectional view taken along the lines 9—9 of FIG. 6.

As may perhaps best be seen from FIG. 6, extending diagonally from adjacent the rear end of the tube 14 is a housing 38 provided with a downwardly extending flange 40 for receiving the upper end of a dip tube 41 which extends into the container B, the housing 38 having an opening 42 communicating with the interior of the flange 40 and extending to a recess 44 in the top wall of the housing 38 (see FIG. 7). A second opening 46 communicates with the closed annular space 26 surrounding the nozzle portion 12 and communicates with the apertures 28 through that nozzle portion 12. The recess 44 receives a sealing washer 48 whose thickness is greater than the depth of the recess so that it extends thereabove, and that washer 48 is provided with openings 42*a* and 46*a* which register with the openings 42 and 46 respectively.

Extending up from the tube 14, and preferably integral therewith, are a pair of spring fingers 50 normally biased somewhat outwardly and provided with outwardly extending protrusions 52 adjacent their upper ends. A rigidifying skeletonic framework defined by cylinder 54 and outwardly extending struts 56 is formed integrally with the tube 14 and with that portion of the rim 4 which extends up above the tube 14. Also a part of the body 2 is an inwardly extending flange 58 vertically dividing the internally threaded portion of the rim 4 from the upper portion thereof. Extending up from the flange 58 is a partial wall 60 with a plurality of spaced upward protrusions 62 thereon.

The forwardly directed face of the rim 4 of the body 2 adjacent the recess 16 is provided with a planar surface 64 with laterally extending lower portions 66 and, partially surrounding it, with a shell comprising a top wall 68, side walls 70 and inwardly extending flanges 72 each provided with three notches 74. The deflector 20 comprises a hood 76 provided at its rear surface with a pair of substantially rigid wings 78 spaced therefrom by structure 80, the spacing between the wings 78 and the rear wall of the hood 76 being substantially equal to the distance between the inner surfaces of the flanges 72 and the surface 64. The surfaces of the wings 78 directed toward the rear wall of the hood 76 are provided with teats 82 of a size designed to be received within the flange notches 72. The exposed surface of the wings 78 are provided with protrusions 84 with abrupt lower edges and tapered upper edges. The wing structure 78, the structure 80 and the rear wall of the hood 76 are provided with an opening 86 designed to register with the recess 16. Inside the hood 76 the deflector is provided with tongues 88 and 90 inclined respectively downwardly and upwardly but with a space 92 between their extremities. The tongues 88 and 90 preferably extend to less than the full depth of the hood 76. The side walls of the hood 76 are provided with index marks 94 designed to register with a corresponding index mark 96 on the wall 70.

The deflector 20 is mounted on the body 2 by sliding the outer edges of the wings 78 inside the flanges 72, the rear surfaces of the wings 78 sliding along the planar surface 64 until the protrusions 84, by virtue of their inclined upper edges, cam the wings 78 past the laterally extending parts 66, the wings 78 then snapping into position with the abrupt edges of the protrusions 84 opposing the portions 66, so that the deflector 20 is permanently mounted on the body 2. When thus permanently mounted it may be moved between three operative positions, the protrusions 82 on the wings 78 snapping into the appropriate notches 74 in the flanges 72, thus bringing the index marks 94 one after another into registration with the index mark 96. In all of those operative positions the opening 86 in the deflector 20 is in communication with the recess 16 on the body 2. In the intermediate position of the deflector 20 the space 92 between the tongues 88 and 90 registers with the fluid stream emanating from the opening 16, the stream then passing through the deflector but being substantially unaffected thereby. In either of its two other operative positions one or the other of the tongues 88, 90 is moved into the path of that stream, thus deflecting the stream either downwardly or upwardly, as the case may be, and also, if, desired, spreading or otherwise changing the shape of the stream by appropriate shaping of the tongues.

Rotatably mounted on the body 2 inside the upstanding portion of the rim 4 is a disc valve generally designated 98, provided with a central opening 100 received over cylinder 54. As may best be seen in FIG. 6, the lower surface 102 of the valve 98, which rides over the sealing washer 48 in the housing 44, is provided with a plurality of recesses 104 defining passages oriented and having a length such as to communicate between the openings **42*a* and 46*a* in the sealing washer 48. As here specifically disclosed, the surface 102 carries twenty such recesses arranged in four groups of five passages each separated by blank spaces 106 which carry no passages or registering apertures. For each operative rotational position of the disc valve 98 one of these recesses 104, or the corresponding blank portion 106, is moved into registration with the sealing washer 48. Each of the recesses 104 preferably differs from the other, thereby to provide a different degree of restriction in flow from one end of the passage to the other, and therefore, from opening 42*a* to opening 46*a*. Most if not all of the recesses are defined by laterally enlarged generally circular vortex areas 110 separated by communicating passages 112, narrower than the areas 110 in width or depth or both. The variation in the recesses 104 may be in terms of the presence or absence or the width and/or depth of the vortex areas 110 and communicating passages 112, or all of them. In FIG. 6 only four recesses 104 are shown in detail as representative of different recess configurations that could be employed. Recess 104*a* is comparatively deep and uniformly continuous to produce, for this particular disc valve 98, maximum aspiration. Recess 104*b* is similar to 104*a* but less deep, producing somewhat less aspiration. Recess 104*c* is typical of intermediate recesses, having vortex areas 110 and communicating restricted passages 112. Recess 104*d* is similar to recess 104*c* but with vortex areas 110 and passages 112 of lesser depth, to produce less aspiration. For further reducing aspiration, an air bleed hole may be provided at the top of any vortex area 110**. It will be understood that these configurations are merely typical, and wide variations in the specifics of their design are possible within the scope of this invention.

At the periphery of the surface 106 are a plurality of recesses 113, one for each operative rotative position of the disc valve 98, which recesses 113 cooperate in detent fashion with the protrusions 62 on the wall 60 forming a part of the body 2. Those protrusions 62 are located substantially diametrically opposite the housing 38, so that the pressure of those protrusions 62 on the disc valve 98 will tend to urge the surface 102 against the upper surface of the sealing washer 48, thereby to produce an effective seal around the particular recess 104 then in operative position.

An actuating knob 115 is rotatably mounted on the body 2, that knob having a depending skirt 114 slidably sealingly received inside the upstanding portion of the rim 4. Inside the skirt 114 are a plurality of depending walls 116, here shown as three in number and preferably non-uniformly circumferentially distributed, which are designed to fit into correspondingly circumferentially oriented notches 118 in the upper surface of the disc valve 98, so that rotation of the knob 115 will cause rotation of the disc valve 98 and so that rotational alignment of the disc valve 98 with the knob 115 is achieved. The knob 115 is provided with a central recess 120 leading to a central aperture 122, and the upper wall of the knob 115 is provided with a pair of diametrically opposed lateral recesses 124. When the knob 115 is moved into position with its walls 116 engaging in the notches 118 of the disc valve 98 the spring fingers 50 extend up through the opening 122 and their outwardly extending protrusions 52 snap into the recess 120, thereby to retain the knob 115 in position. A coil spring 126 extends around the cylinder 54, bears axially against the disc valve 98 and the knob 115, and is compressed therebetween when the knob 115 is engaged by the spring finger protrusions 52. The spring 126 therefore performs three functions—it serves to press the disc valve 98 downwardly into sealing engagement with the sealing washer 48 and to urge the disc valve 98 into detenting engagement with the protrusions 62, and it also urges the knob 115 upwardly against the spring finger protrusions 52, so that if those protrusions 52 are moved toward one another the knob 115 will be released and spring-urged upwardly, thus facilitating disassembly.

While the knob 115 sealingly engages the body 2, atmospheric pressure enters the knob through the recesses 124 and around the spring fingers 52, thereby to ensure that the interior of the container B is maintained at atmospheric pressure, so that aspiration will proceed in expected fashion.

In order to prevent accidental separation of the knob 115, a plug 128 is provided, that plug having a top wall 129 received on a ledge 130 in the knob recess 120 and having a depending portion 131 which fits snugly between the upper ends of the spring fingers 50, thus preventing those fingers from moving inwardly and releasing the knob 115 for so long as the plug 128 is in position.

The upper surface of the knob 115 is provided with appropriate indicia 132 designed to cooperate with a fixed index point 134 to indicate which of the recesses 104 or the blanks 106 is in operative engagement with the sealing washer 48, thus indicating to the operator what degree of aspiration is to be expected.

That fixed index 134, in the form of a triangle, is here disclosed as being defined by a recess in the mounting structure 8 extending rearwardly from the body 2, that structure having a recess **134*a* diametrically opposite the recess 134. The nozzle structure 10 includes a back plate 138 radially larger than the mounting structure 8, and extending forwardly from that plate 138 and preferably integral therewith are a pair of spring fingers 140 with outward protrusions 142 at their extremities, those outward protrusions being triangular in shape so as to be received within the openings 134 and 134***a*. Thus the nozzle 10 is assembled with the sprayer simply by being moved axially thereinto, and it can be disassembled by moving the spring fingers 140 toward one another by pressing on the protrusions 142 exposed in the openings 134 and 134*a*. Mounted on the back plate 138 of the nozzle 10 is the coupling nut D and, desirably, an anti-siphon valve generally designated 144.

Fluid from the garden hose C will enter the nozzle 10 and flow through it and the passage 18 to the end recess 16, and in so flowing it will pass over the openings 28, producing a suction which will be communicated through the annular space 26 and the openings 46 and 46*a* to the upper surface of the sealing washer 48. When the disc valve 98 is in one of its operating positions where a blank 126 is located in registration with the sealing washer 48, the opening 46*a* will be sealed off, the suction will be ineffective and no aspiration will occur. However, if the valve 98 is in one of its operative positions where a recess 104 is in registration with the sealing washer 48, that suction will be transmitted through the operative recess 104 and the openings 42*a* and 42 to the dip tube 41, and hence the liquid within the container A will be sucked up to the aspiration opening 28, there to be entrained in the carrier fluid. The rate of flow of the aspirated material will be determined by the characteristics of the operative recess 104, and because of the wide degree of variation permitted in the design of those recesses and the large number of such recesses which can be incorporated into a given disc valve 98, a very wide degree of control of the degree of aspiration can be obtained. For example, in one commercial embodiment of the present invention aspiration ratios varying from 16 parts of water to one part of insecticide to 133 parts of water to one part insecticide can be achieved, thus involving a variation between 3 gallons of water and 25 gallons of water which must be sprayed to empty the particular container B involved. In another commercial embodiment a particular twenty-passage disc valve 98 provides for a variation of 25.6 gallons of hose water required to aspirate a gallon of insecticide to 768 gallons of hose water to achieve the same effect. Thus it is seen that major changes may be made in the degree of aspiration achieved simply by substituting one valve 98 for another, something that can readily be done simply by removing the plug 128.

Further control of the degree of variation of aspiration rate can optionally be accomplished by providing a given passage 104 with an air bleed hole.

Optional apertures 108 and 148 in the disc valve 98 play no part in aspiration. They are drain holes so that any fluid which collects on the valve 98 may drain down into the container B.

As may best be seen from FIG. 6, the skeleton-like nature of the body 2 ensures that the lower surface 102 of the disc valve 98 is exposed even while the parts are fully assembled. This is an important maintenance feature. Any accumulation of foreign matter or coagulated aspiration material in a given passage 104 will alter, often to a considerable degree, the aspiration-rate-controlling effect of that passage. Because those passages 104 are exposed, as shown in FIG. 6, they may be readily inspected to ascertain that they are in proper condition and may be readily cleaned if they are not.

The annular space 32 and opening 34 are used to test for leaks around the nozzle 10. When carrier fluid is caused to flow through the sprayer while it is separated from the container B, leaks will result in fluid dropping through the opening 34.

All of the parts of the sprayer may be conveniently and relatively inexpensively formed of molded plastic (it is preferred, however, to use metal for the spring 126) and hence they can be inexpensively manufactured on a large scale. Furthermore, the parts are designed for ready assembly during manufacture and ready disassembly for repair or replacement of parts. The parts are exceptionally sturdy, and hence the sprayer has long life. The degree of aspiration can be controlled over an exceptionally wide range, a particularly strong jet-like stream of carrier fluid, with or without insecticide, is produced, thus enabling the user of the device to stand at a safe distance from the thing being sprayed, and the nature and direction of the outlet stream can be modified at will.

While but a single embodiment of the present invention has been here specifically disclosed, it will be apparent that many variations may be made therein, all within the scope of the present invention as defined in the following claims.

We claim:

1. In an aspiration type sprayer comprising a supporting body adapted to be connected to a source of carrier fluid and having means for guiding a stream of carrier fluid past an aspiration opening and then out from said body, and fluid communication means between said aspiration opening and the interior of a container with which said body is associated, the improvement which comprises said fluid communication means comprising a part operatively connected to said body and having a pair of spaced openings communicating respectively with said aspiration opening and said container interior, both of said openings having valve-engaging surfaces facing in a first direction, a valve member sealingly movably engageable with said part over said openings and having a plurality of passages of different selectively movable into registration with said pair of openings, said passages being open in a second direction opposite to said first direction, an actuating element located in said first direction with respect to said valve member, operatively connected thereto for movement therewith, and exposed for manual manipulation, spring means operatively engaging said valve member for urging the latter in said second direction into sealing engagement with said part, and means operatively connecting said part and said actuating element to limit the upward movement of the actuating element relative to said body.

2. The sprayer of claim 1, in which said valve member and actuating element are rotatable relative to said part.

3. The sprayer of either of claims 1 or 2, in which said valve member is above said part, said passages are exposed on the bottom of said valve member, and said part is so connected to said body that a relatively large open space is formed in said body beneath said valve member, thereby to expose said passages in said valve member for cleaning without requiring disassembly of said sprayer.

4. The sprayer of either of claims 1 or 2, in which said upward movement limiting means comprises spring fingers extending up from said body and snap-engaging said actuating element.

5. The sprayer of either of claims 1 or 2, in which said upward movement limiting means comprises spring fingers extending up from said body and snap-engaging said actuating element, said fingers being non-rotatable with respect to said body and said actuating element being rotatable with respect to said fingers.

6. The sprayer of either of claims 1 or 2, in which said upward movement limiting means comprises spring fingers extending up from said body and snap-engaging said actuating element, and plug means removably receivable between said spring fingers after said fingers have engaged said actuating element, thereby to prevent undesired separation of said spring fingers from said actuating element.

7. The sprayer of either of claims 1 or 2, in which said upward movement limiting means comprises spring fingers extending up from said body and snap-engaging said actuating element, said fingers being non-rotatable with respect to said body and said actuating element being rotatable with respect to said fingers, and plug means removably receivable between said spring fingers after said fingers have engaged said actuating element, thereby to prevent undesired separation of said spring fingers from said actuating element.

8. The sprayer of either of claims 1 or 2, in which said spring means also engages said actuating element for urging it upwardly.

9. The sprayer of claim 8, in which said spring means comprises a spring engaging and compressed between said valve member and said actuating element.

10. The sprayer of claim 8, in which said spring means comprises a spring engaging and compressed between said valve member and said actuating element, and said upward movement limiting means comprise spring fingers extending up from said body and snap-engaging said actuating element, said fingers being non-rotatable with respect to said body and said actuating element being rotatable with respect to said fingers.

11. In an aspiration type sprayer comprising a supporting body adapted to be connected to a source of carrier fluid and having means for guiding a stream of carrier fluid past an aspiration opening and then out from said body, and fluid communication means between said aspiration opening and the interior of a container with which said body is associated, the improvement which comprises said fluid communication means comprising a part having a pair of spaced openings communicating respectively with said aspiration opening and said container interior, both of said openings having valve-engaging surfaces facing in an upward direction, a valve member sealingly movably engageable with said part over said openings and having a plurality of passages of different sizes on the lower surface of said member which are open in a downwardly facing direction and selectively movable into registration with said pair of openings, an actuating element located upwardly of and operatively connected to said valve member for moving the latter, and said part is so connected to said body that a relatively large open space is formed in said body beneath said valve member, thereby to expose said passages in said valve member for cleaning without requiring disassembly of said sprayer.

12. In an aspiration type sprayer comprising a supporting body adapted to be connected to a source of carrier fluid and having means for guiding a stream of carrier fluid past an aspiration opening and then out from said body, and fluid communication means between said aspiration opening and the interior of a container with which said body is associated, the improvement which comprises said fluid communication means comprising a part having a pair of spaced openings communicating respectively with said aspiration opening and said container interior, both of said openings having valve-engaging surfaces facing in an upward direction, a valve member sealingly movably engageable with said part over said openings and having a plurality of passages of different sizes on the surface of said member each separate from the other and engageable with said parts which passages are open in a downward direction and selectively movable into registration with said pair of openings, and an actuating element located upwardly of and operatively connected to said valve member for moving the latter, whereby said material to be aspirated passes through the part via the first of said openings, through said passage, and then again through said part via the second of said openings.

13. The sprayer of claim 12, in which both of said openings face in one direction toward said valve member and said passage extends substantially perpendicular to said one direction, whereby said material to be aspirated moves in said one direction, then substantially at right angles thereto, and then in a direction opposite to said one direction.

14. The sprayer of claim 12, in which said passages are exposed on said surface of said valve member which sealingly engages said part.

15. The sprayer of claim 13, in which said passages are exposed on said surface of said valve member which sealingly engages said part.

16. The sprayer of any of claims 12–15, in which said passage is comprised of a plurality of radially enlarged vortex areas interconnected by spaces of lesser width than said vortex areas.

17. The sprayer of any of claims 12–15, in which said passage is comprised of a plurality of radially enlarged vortex areas interconnected by spaces of lesser width and depth than said vortex areas.

18. In an aspiration type sprayer comprising a supporting body adapted to be connected to a source of carrier fluid and having means for guiding a stream of carrier fluid past an aspiration opening and then out from said body, and fluid communication means between said aspiration opening and the interior of a container with which said body is associated, the improvement which comprises said fluid communication means comprising a part operatively connected to said body and having a pair of spaced openings communicating respectively with said aspiration opening and said container interior, a valve member sealingly movably engageable with said part over said openings and having a plurality of passages of different sizes selectively movable into registration with said pair of openings, an actuating element located above said valve member, operatively connected thereto for movement therewith, and exposed for manual manipulation, spring means operatively engaging said valve member for urging the latter into sealing engagement with said part, and means operatively connecting said part and said actuating element to limit the upward movement of the actuating element relative to said body, in which said upward movement limiting means comprises spring fingers extending up from said body and snap-engaging said actuating element.

19. In an aspiration type sprayer comprising a supporting body adapted to be connected to a source of carrier fluid and having means for guiding a stream of carrier fluid past an aspiration opening and then out from said body, and fluid communication means between said aspiration opening and the interior of a container with which said body is associated, the improvement which comprises said fluid communication means comprising a part operatively connected to said body and having a pair of spaced openings communicating respectively with said aspiration opening and said container interior, a valve member sealingly movably engageable with said part over said openings and having a plurality of passages of different sizes selectively movable into registration with said pair of openings, an actuating element located above said valve member, operatively connected thereto for movement therewith, and exposed for manual manipulation, spring means operatively engaging said valve member for urging the latter into sealing engagement with said part, and means operatively connecting said part and said actuating element relative to said body, in which said upward movement limiting means comprises spring fingers extending up from said body and snap-engaging said actuating element, said fingers being non-rotatable with respect to said body and said actuating element being rotatable with respect to said fingers.

20. In an aspiration type sprayer comprising a supporting body adapted to be connected to a source of carrier fluid and having means for guiding a stream of carrier fluid past an aspiration opening and then out from said body, and fluid communication means between said aspiration opening and the interior of a container with which said body is associated, the improvement which comprises said fluid communication means comprising a part operatively connected to said body and having a pair of spaced openings communicating respectively with said aspiration opening and said container interior, a valve member sealingly movably engageable with said part over said openings and having a plurality of passages of different sizes selectively movable into registration with said pair of openings, an actuating element located above said valve member, operatively connected thereto for movement therewith, and exposed for manual manipulation, spring means operatively engaging said valve member for urging the latter into sealing engagement with said part, and means operatively connecting said part and said actuating element relative to said body, in which said upward movement limiting means comprises spring fingers extending up from said body and snap-engaging said actuating element, and plug means removably receivable between said spring fingers after said fingers have engaged said actuating element, thereby to prevent undesired separation of said spring fingers from said actuating element.

21. In an aspiration type sprayer comprising a supporting body adapted to be connected to a source of carrier fluid and having means for guiding a stream of carrier fluid past an aspiration opening and then out from said body, and fluid communication means between said aspiration opening and the interior of a container with which said body is associated, the improvement which comprises said fluid communication means comprising a part operatively connected to said body and having a pair of spaced openings communicating respectively with said aspiration opening and said container interior, a valve member sealingly movably engageable with said part over said openings and having a plurality of passages of different sizes selectively movable into registration with said pair of openings, an actuating element located above said valve member, operatively connected thereto for movement therewith, and exposed for manual manipulation, spring means operatively engaging said valve member for urging the latter into sealing engagement with said part, and means operatively connecting said part and said actuating element relative to said body, in which said upward movement limiting means comprises spring fingers extending up from said body and snap-engaging said actuating element, said fingers being non-rotatable with respect to said body and said actuating element being rotatable with respect to said fingers, and plug means removably receivable between said spring fingers after said fingers have engaged said actuating element, thereby to prevent undesired separation of said spring fingers from said actuating element.

22. In an aspiration type sprayer comprising a supporting body adapted to be connected to a source of carrier fluid and having means for guiding a stream of carrier fluid past an aspiration opening and then out from said body, and fluid communication means between said aspiration opening and the interior of a container with which said body is associated, the improvement which comprises said fluid communication means comprising a part operatively connected to said body and having a pair of spaced openings communicating respectively with said aspiration opening and said container interior, a valve member sealingly movably engageable with said part over said openings and having a plurality of passages of different sizes selectively movable into registration with said pair of openings, an actuating element located above said valve member, operatively connected thereto for movement therewith, and exposed for manual manipulation, spring means operatively engaging said valve member for urging the latter into sealing engagement with said part, and means operatively connecting said part and said actuating element relative to said body, in which said spring means also engages said actuating element for urging it upwardly, and in which said spring means comprises a spring engaging and compressed between said valve member and said actuating element.

23. In an aspiration type sprayer comprising a supporting body adapted to be connected to a source of carrier fluid and having means for guiding a stream of carrier fluid past an aspiration opening and then out from said body, and fluid communication means between said aspiration opening and the interior of a container with which said body is associated, the improvement which comprises said fluid communication means comprising a part operatively connected to said body and having a pair of spaced openings communicating respectively with said aspiration opening and said container interior, a valve member sealingly movably engageable with said part over said openings and having a plurality of passages of different sizes selectively movable into registration with said pair of openings, an actuating element located above said valve member, operatively connected thereto for movement therewith, and exposed for manual manipulation, spring means operatively engaging said valve member for urging the latter into sealing engagement with said part, and means operatively connecting said part and said actuating element relative to said body, in which said spring means also engages said actuating element for urging it upwardly, and in which said spring means comprises a spring engaging and compressed between said valve member and said actuating element, and said upward movement limiting means comprise spring fingers extending up from said body and snap-engaging said actuating element, said fingers being non-rotatable with respect to said body and said actuating element being rotatable with respect to said fingers.

24. The sprayer of any of claims 18–23, in which said valve member and actuating element are rotatable relative to said part.

25. In an aspiration type sprayer comprising a supporting body adapted to be connected to a source of carrier fluid and having means for guiding a stream of carrier fluid past an aspiration opening and then out from said body, and fluid communication means between said aspiration opening and the interior of a container with which said body is associated, the improvement which comprises said fluid communication means comprising a part having a pair of spaced openings communicating respectively with said aspiration opening and said container interior, a valve member sealingly movably engageable with said part over said openings and having a plurality of passages of different sizes on the surface of said member engageable with said parts which passages are selectively movable into registration with said pair of openings, and an actuating element operatively connected to said valve member for moving the latter, whereby said material to be aspirated passes through said part via the first of said openings, through said passage, and then again through said part via the second of said openings, in which said passage is comprised of a plurality of radially enlarged vortex areas interconnected by spaces of lesser width than said vortex areas.

26. In an aspiration type sprayer comprising a supporting body adapted to be connected to a source of carrier fluid and having means for guiding a stream of carrier fluid past an aspiration opening and then out from said body, and fluid communication means between said aspiration opening and the interior of a container with which said body is associated, the improvement which comprises said fluid communication means comprising a part having a pair of space openings communicating respectively with said aspiration opening and said container interior, a valve member sealingly movably engageable with said part over said openings and having a plurality of passages of different sizes on the surface of said member engageable with said parts which passages are selectively movable into registration with said pair of openings, and an actuating element operatively connected to said valve member for moving the latter, whereby said material to be aspirated passes through said part via the first of said openings, through said passage, and then again through said part via the second of said openings, in which said passage is comprised of a plurality of radially enlarged vortex areas interconnected by spaces of lesser width and depth than said vortex areas.

27. The aspiration type sprayer of either of claims 25 or 26, in which both of said openings face in one direction toward said valve member and said passage extends substantially perpendicular to said one direction, whereby said material to be aspirated moves in said one direction, then substantially at right angles thereto, and then in a direction opposite to said one direction.

28. The aspiration type sprayer of either of claims 25 or 26, in which said passages are exposed on said surface of said valve member which sealingly engages said part.

* * * * *